US006206354B1

(12) United States Patent
Lin

(10) Patent No.: US 6,206,354 B1
(45) Date of Patent: Mar. 27, 2001

(54) VISE HAVING AUTOMATIC LOCATING MECHANISM

(76) Inventor: Philip Lin, No. 537-8, Chung Shan Road, Ching Shui Chen, Taichung Hsien (TW)

( * ) Notice: Subject to any disclaimer, the term of this patent is extended or adjusted under 35 U.S.C. 154(b) by 0 days.

(21) Appl. No.: 09/309,259

(22) Filed: May 11, 1999

(30) Foreign Application Priority Data

May 28, 1998 (TW) ..... 87208346

(51) Int. Cl.[7] ..... B25B 1/10

(52) U.S. Cl. ..... 269/43; 269/271; 269/215; 269/244; 269/136

(58) Field of Search ..... 269/43, 271, 215, 269/244, 216

(56) References Cited

U.S. PATENT DOCUMENTS 595,546 * 12/1897 O'Brien ..... 269/216
807,788 * 12/1905 Stetler ..... 269/43
2,880,638 4/1959 Muggi et al. .
4,529,183 7/1985 Krason et al. .
5,098,073 * 3/1992 Lenz ..... 269/43
5,160,127 11/1992 Lin .
5,242,159 * 9/1993 Bernstein ..... 269/43
5,374,040 * 12/1994 Lin ..... 269/216
5,458,321 * 10/1995 Durfee, Jr. ..... 269/136
5,893,551 * 4/1999 Cousins et al. ..... 269/136
5,984,290 * 11/1999 Durfee, Jr. ..... 269/43

* cited by examiner

*Primary Examiner*—James G. Smith
*Assistant Examiner*—Lee Wilson
(74) *Attorney, Agent, or Firm*—Browdy & Neimark

(57) ABSTRACT

A vise is composed of a base, a first transmission block, a second transmission block, a first movable jaw mounted on the first transmission block, a second movable jaw mounted on tee second transmission block, a control rod located in a slot of the base such that the control rod is engaged with the first transmission block and the second transmission block and that the control rod is capable of being actuated by a handle to drive the movable jaws to move toward or away from a fixed jaw located between the two movable jaws. The first transmission block is provided with two guide rods and a locating mechanism fastened with the guide rods.

3 Claims, 5 Drawing Sheets

VISE HAVING AUTOMATIC LOCATING MECHANISM

FIELD OF THE INVENTION

The present invention relates generally to a vise, and more particularly to a vise having an automatic locating mechanism.

BACKGROUND OF THE INVENTION

The U.S. Pat. No. 5,374,040 discloses a vise which is composed of a rectangular base, two movable jaws, two transmission blocks, a control rod, a fixed jaw, a fitting tube, two end members, at least one elastic element, and a fastening block. Such a prior art vise as described above is limited in design in that the fastening block must be loosened each time when a work piece is to be worked on, and that the control rod is jutted out of the base, thereby causing a great deal of inconvenience to an operator.

SUMMARY OF THE INVENTION

The primary objective of the present invention is therefore to provide an improved vise free from the drawbacks of the prior art vise described above.

The objective, features and functions of the present invention will be readily understood upon a thoughtful deliberation of the following detailed description of the present invention with reference to the accompanying drawings.

DETAILED DESCRIPTION OF THE INVENTION

Figure 1:
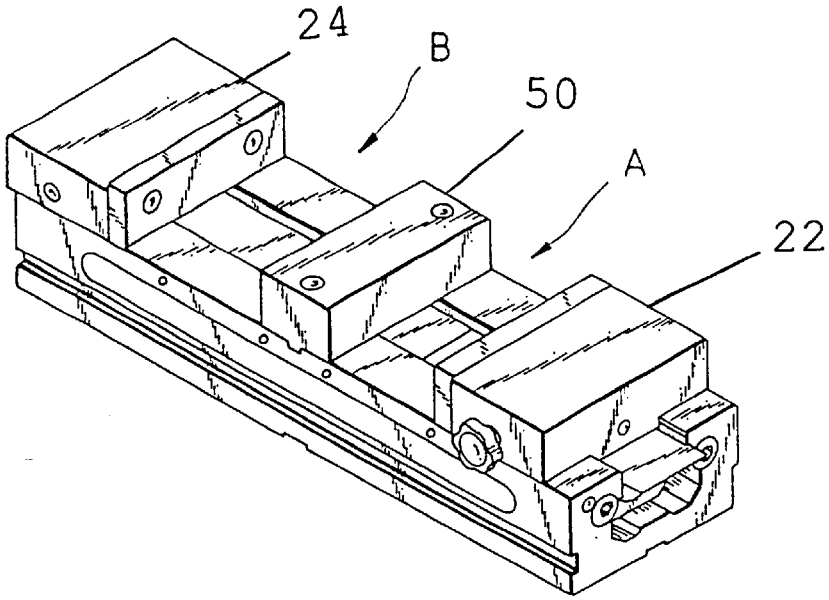
FIG. 1 shows a perspective view of the present invention.
Figure 3:
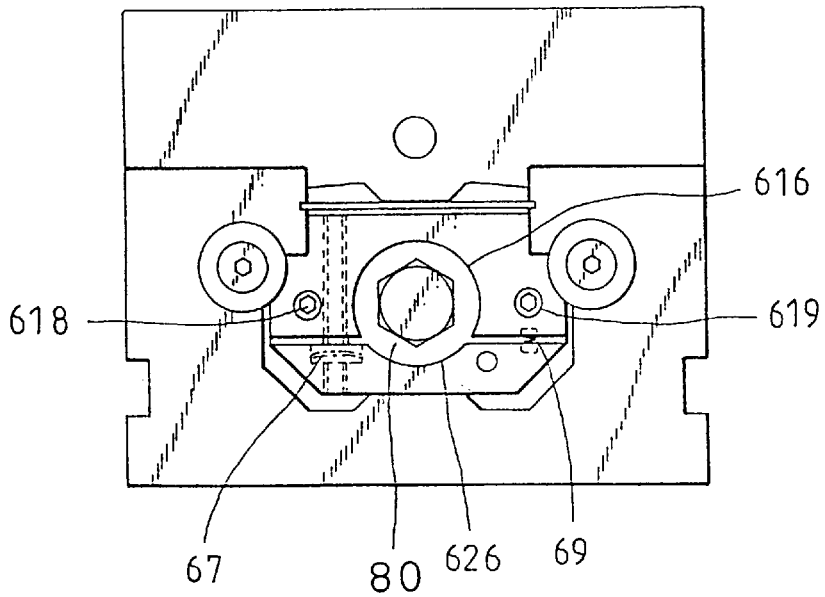
FIG. 3 shows a right side view of the present invention shown in FIGS. 1 and 3.
Figure 2:
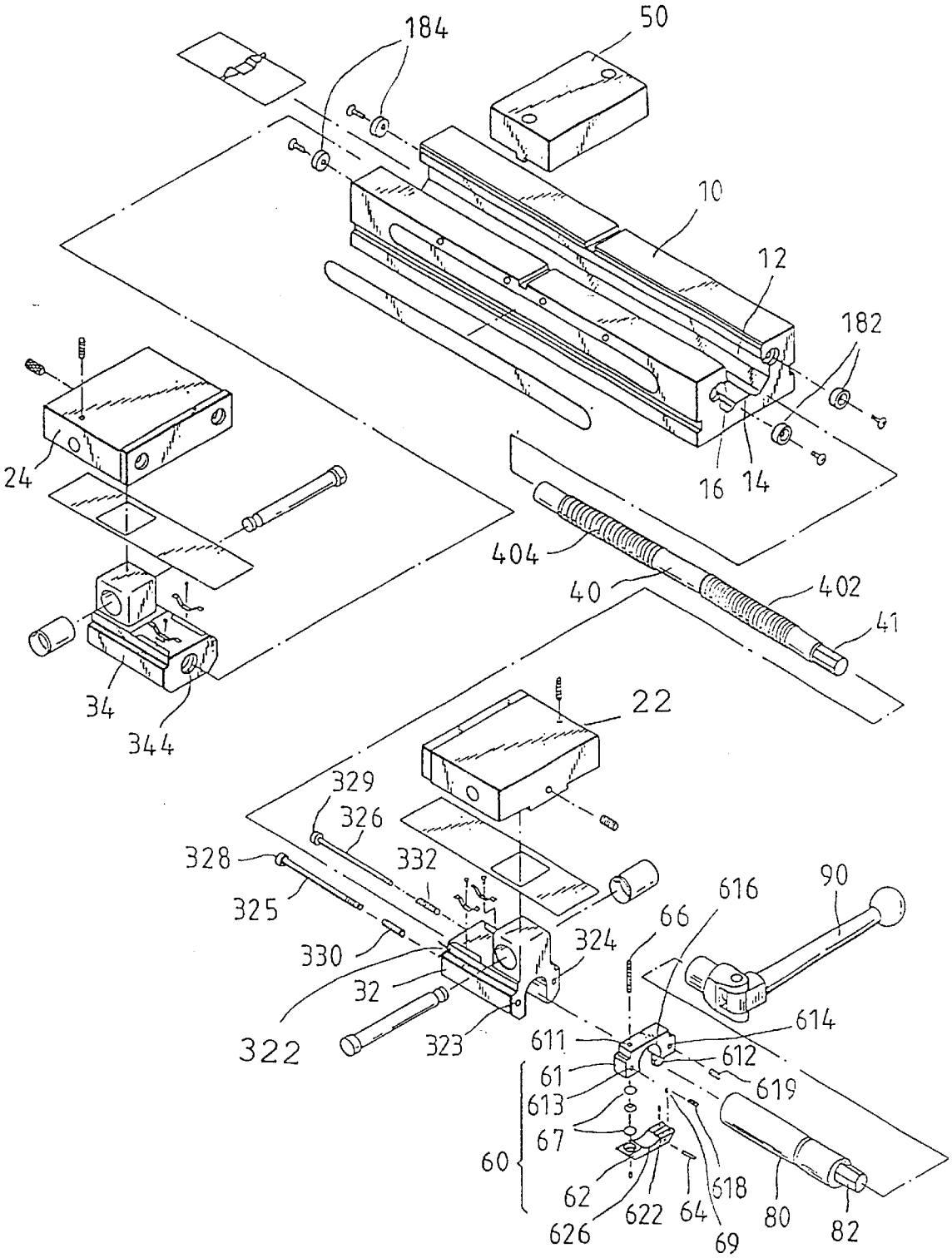
FIG. 2 shows an exploded view of the present invention.
Figure 4:
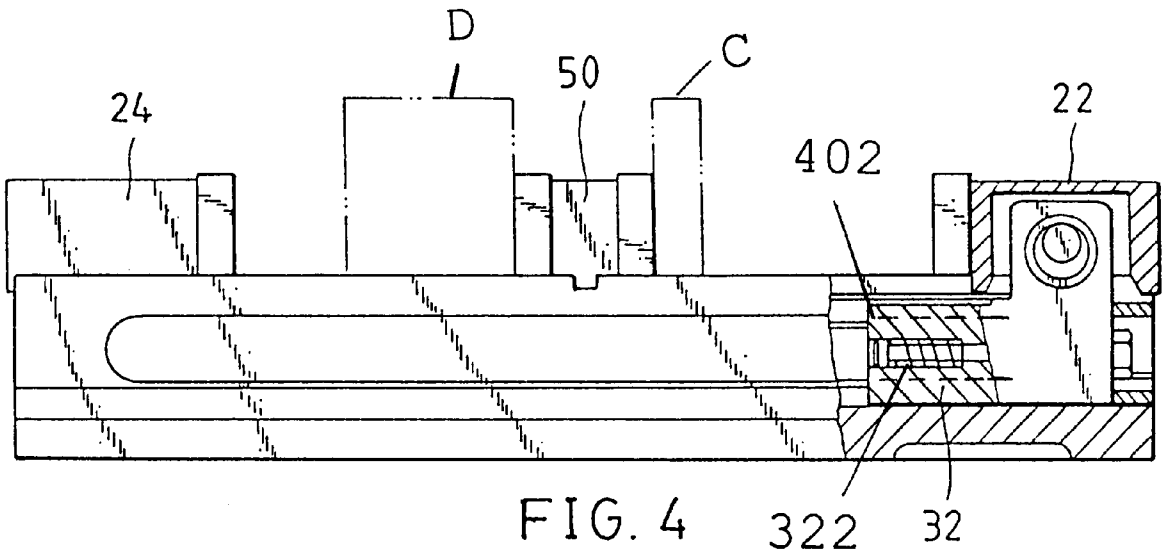
FIGS. 4–7 are sectional schematic views of the present invention at work.

As shown in FIGS. 1–8, a vise embodied in the present invention is composed of the component parts which are described hereinafter.

A base 10 of a rectangular construction is provided with a slot 12 of an inverted T-shaped construction.

Two movable jaws 22 and 24 are mounted on the base 10.

Two transmission blocks 32 and 34 are fastened with the two movable jaws 22 and 24 such that the two transmission blocks 32 and 34 are suspended in the slot 12. The transmission blocks of the present invention may be similar in design to those disclosed in the U.S. Pat. Nos. 4,529,183; 2,880,638; and 5,160,127. The transmission blocks 32, 34 are provided respectively in the center thereof with a threaded hole 322, 344. The threaded hole 322 is coaxial with and opposite in the thread direction to the threaded hole 344 when blocks 32, 34 are in slot 12. The first transmission block 32 is provided with two through holes 323 and 324, which extend along the direction of a longitudinal axis of the first transmission block 32.

A control rod 40 is provided with two threaded segments 402 and 404, which are engaged with the threaded holes 322 and 344 of the transmission blocks 32 and 34. The control rod 40 is provided at one end thereof with a connection portion 41.

Two first stop members 182 are fastened with one end of the base 10. Two second stop members 184 are fastened with another end of the base 10 for preventing the transmission blocks 32 and 34 from slipping out of the slot 12.

A fixed jaw 50 is detachably fastened to the middle of the top of the base 10 such that the fixed jaw 50 and the two movable jaws 22 and 24 form two clamping spaces A and B.

An extension sleeve 80 is connectable at one end thereof with the connection portion 41 of the control rod 40 and is provided at another end thereof with a fastening portion 82.

A handle 90 is fastened with the fastening portion 82 of the extension sleeve 80 for actuating the control rod 40 to rotate. The handle 90 may be fastened with the connection portion 41 of the control rod 40.

A locating mechanism 60 is formed of two locating members 61 and 62, which are located in the slot 12 of the base 10 such that the first locating member 61 urges a shoulder 16 of the slot 12. The first locating member 61 is provided with a recess 616 in and a side wall of member 61 with two threaded through holes 613 and 614. The first locating member 61 is further provided at one end thereof with a pivoting portion 612, and at another end thereof with a third threaded through hole 611. The second locating member 62 urges the bottom 14 of the slot 12 and is provided with a recess 626 and a depression 622 for engaging the pivoting portion 612 of the first locating member 61 in conjunction with a pin 64 and a spring 69 which is located between the pivoting ends of the first and the second locating members 61 and 62. The recesses 616 and 626 are of a semicircular construction and can be thus joined together to form a through hole 68 to accommodate the control rod 40.

Two guide rods 325 and 326 are received in the two through holes 323 and 324 of the first transmission block 32. The guide rods 325 and 326 are provided respectively at one end thereof with an arresting portion 328, 329, and are engaged respectively at another end thereof with the threaded through hole 613, 614 on first locating member 61.

Two adjusting members (screws) 618 and 619 are engaged with the threaded through holes 613 and 614 for regulating the locating depth of the guide rods 325 and 326, so as to adjust the distance between the transmission blocks 32 and the first locating member 61.

Two springs 330 and 332 are fitted over the two guide rods 325 and 326 such that the arresting portions 328 and 329 of the guide rods 325 and 326, and the transmission blocks 32 are urged by the springs 330 and 332.

Two elastic pieces 67 are located between the first and the second locating members 61 and 62 such that the locating members 61 and 62 are urged to respectively press against shoulder 16 and bottom 14 of the slot 12 of the base 10.

Figure 8:
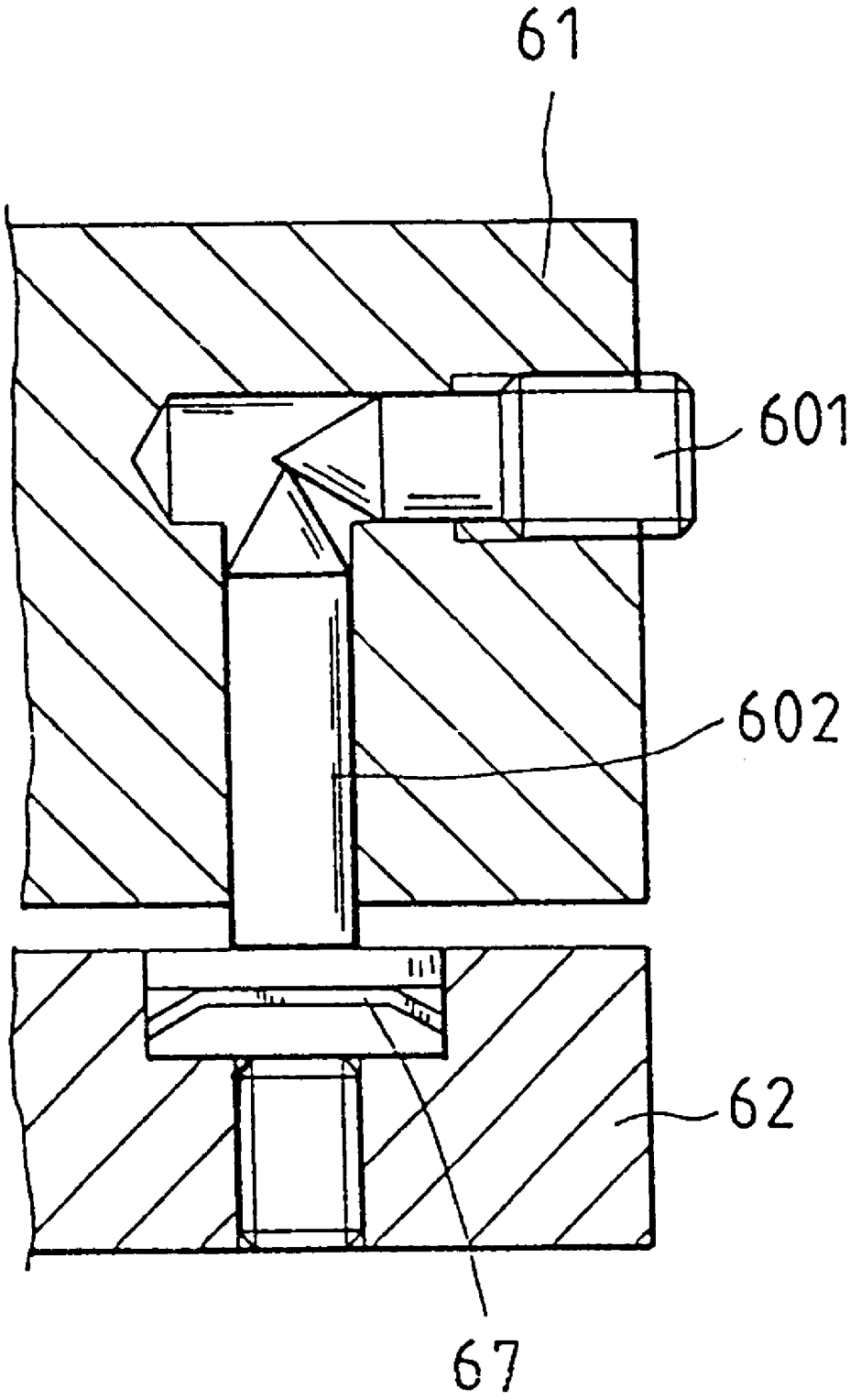
FIG. 8 shows a partial sectional view of the present invention.

An adjusting element 66 (a screw) is engaged with the third threaded hole 611 such that the adjusting element 66 is jutted out of the third threaded hole 611 to urge the elastic pieces 67 for adjusting the static friction between the first locating member 61 and the base 10. The adjusting screw 66 may be replaced by a tapered guide rod 602 capable of cooperating with a tapered screw 601 of the first locating member 61, as shown in FIG. 8. The extension of the tapered guide rod 602 can be confined by the tapered screw 601.

Figure 5:
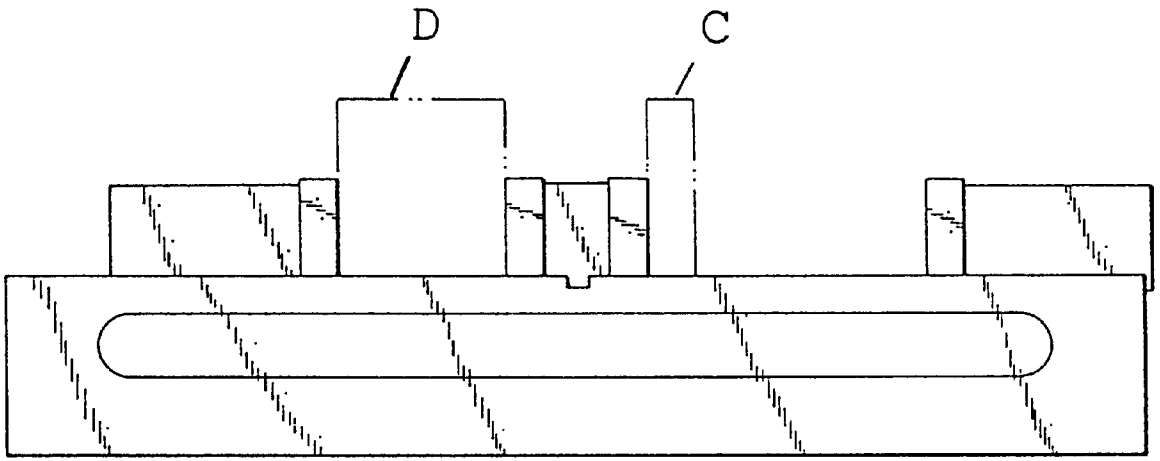
Figure 6:
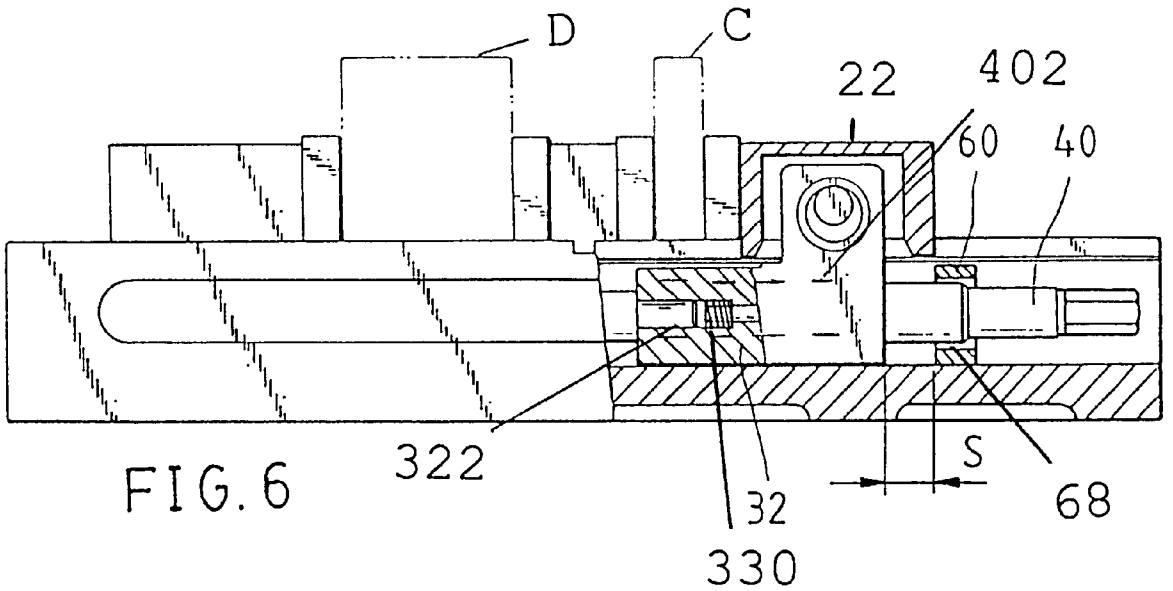
Figure 7:
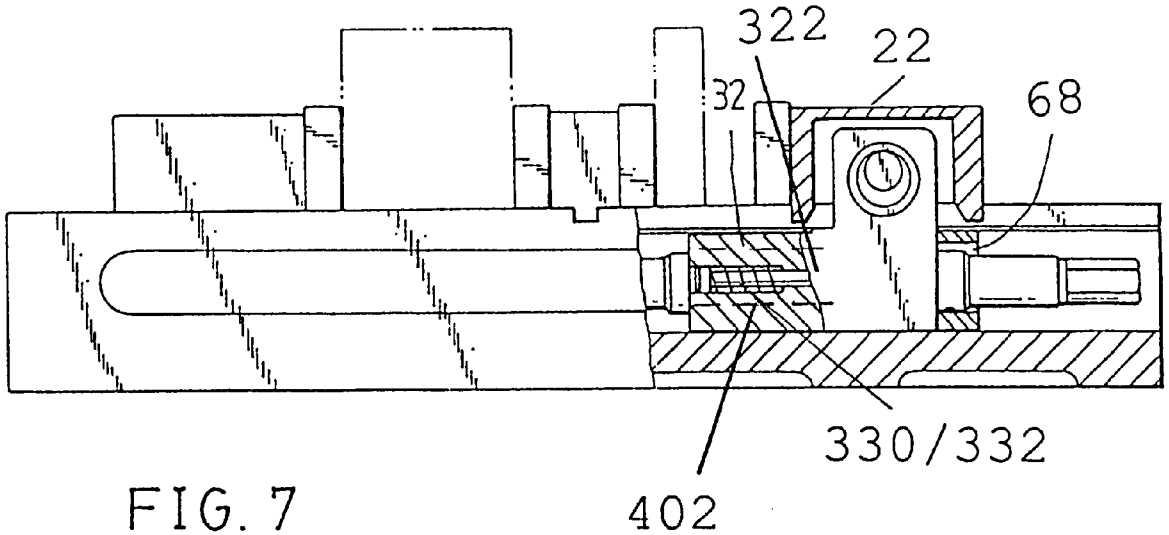

As illustrated in FIGS. 4–7, the control rod 40 is turned by handle 98 to drive the transmission blocks 32 and 34 such that the movable jaws 22 and 24 are moved toward the fixed jaw 50. In view of the fact that the movement of first transmission block 32 is decreased by the friction force of the locating members 61 and 62 holding transmission block 32, only the second transmission block 34 and the control rod 40 are allowed to move until work piece D is clamped by the second movable jaw 24 and the fixed jaw 50 as shown in FIG. 5. Thereafter, the first transmission block 32 is exerted on by a clamping reaction force of second transmission block 34 against work piece D which is greater than the static friction force between slot 12 and the locating members 61 and 62. As a result, the first transmission block 32 and the control rod 40 are now caused to move toward the fixed jaw 50 to compress the springs 328 and 329 as the locating mechanism 60 is moved against friction in slot 12. A Work piece C is then clamped by the first movable jaw 22 and the fixed jaw 50 as shown in FIG. 6. In the meantime, the springs 328 and 329 remain in the state of being compressed by the first transmission block 32 which is separated from the locating members 61 and 62 by a distance S, as shown in FIG. 6. Thereafter, the locating mechanism 60 remains in the position shown in FIG. 6 when the movable jaw 22 is moved back away from workpiece L as shown in FIG. 7 to permit replacing workpiece C.

What is claimed is:

1. A vise adapted to engage a first workpiece (C) and a second workpiece (D) comprising:

a base (10) having a slot (12) on an upper surface thereof extending along a longitudinal length of the base;

a first transmission block (32) and a second transmission block (34) slidably mounted in said slot (12) the first transmission block (32) being located at a first end of the slot (12), and the second transmission block (34) being located at a second end of said slot (12), the first transmission block provided with a first threaded hole (322) and two through holes (323, 324) all of which (322, 323, 324) extend along a longitudinal length of the first transmission block (32);

the second transmission block (34) provided with a second threaded hole (344) extending along a longitudinal length thereof;

said first threaded hole (322) and said second threaded hole (344) being coaxial and having thread directions opposite to each other;

a first movable jaw mounted on said first transmission block, a second movable jaw mounted on said second transmission block, and a fixed jaw mounted on said base, said fixed jaw being located between said first movable jaw and said second movable jaw;

a first space (A) between the first transmission block (32) and the fixed jaw adapted to receive the first workpiece (C) and a second space (B) between the second transmission block (34) adapted to receive the second workpiece (D);

a control rod provided at a first end thereof with a first threaded segment and at a second end thereof with a second threaded segment, said control rod further provided at said first end with a connection portion, said control rod being located in said slot of said base, said first threaded segment of said control rod being engaged with said first threaded hole of said first transmission block, and said second threaded segment of said control rod being engaged with said second threaded hole of said second transmission block, wherein said opposite thread direction permits said control rod to drive said movable jaw and said second movable jaw to move either toward or away from said fixed jaw;

a handle fastened with said connection portion of said control rod such that said handle can be rotated manually to actuate said control rod to rotate and drive said first transmission block and said second transmission block; and locating means (60) engaged in said slot (12) and to said first transmission block for frictionally holding said first transmission block (32) from moving in slot (12) while said control rod is rotated to move said second transmission block in said slot (12) and after engagement of said second transmission block with the second workpiece (D) in the second space, permitting movement of the first transmission block into engagement with the first workpiece in the first space.

2. The vise according to claim 1, wherein said first transmission block is engaged to said locating means by two guide rods (325, 326) each slidably engaged respectively in said two through holes (323, 324) of the first transmission block with a spring fitted thereover which is engaged between the first transmission block and a free end of each of the two guide rods.

3. The vise according to claim 2, wherein the locating means comprises, a first locating member (61) and a second locating member (62), said first locating member provided with a first threaded hole (613), a second threaded through hole (614) parallel to said first threaded through hole, said first locating member further provided with a third threaded through hole (611), said first locating member (61) being fastened with said first transmission block by the two guide rods (325, 326) which are respectively engaged with said first threaded through hole (613) and said second threaded through hole (614) of said first locating member, said first locating portion further provided with a pivoting portion (612) which is engaged pivotally with a recess (622) of said second locating member such that a plurality of elastic pieces (67) are located between said first locating member (61) and said second locating member (62) and that frictional engagement of said first locating member and said second locating member in slot (12) can be adjusted by an adjusting element (66) which is engaged with said third threaded hole (611) of said first locating member.

* * * * *